US006354726B2

(12) United States Patent
Foerster

(10) Patent No.: US 6,354,726 B2
(45) Date of Patent: Mar. 12, 2002

(54) METHOD AND DEVICE FOR MIXING AND CONVEYING CONCRETE

(75) Inventor: Werner Foerster, Grub (DE)

(73) Assignee: Kaeser Compressoren GmbH, Coburg (DE)

( * ) Notice: Subject to any disclaimer, the term of this patent is extended or adjusted under 35 U.S.C. 154(b) by 0 days.

(21) Appl. No.: 09/770,951

(22) Filed: Jan. 26, 2001

(30) Foreign Application Priority Data

Jan. 27, 2000 (DE) ..... 200 01 472 U
Jul. 11, 2000 (DE) ..... 100 33 663

(51) Int. Cl.[7] ..... B01F 15/02; B28C 5/10; B28C 5/96

(52) U.S. Cl. ..... 366/3; 366/5; 366/13; 366/64; 366/191

(58) Field of Search ..... 366/5, 13, 64, 366/191, 3; 417/118, 119

(56) References Cited

U.S. PATENT DOCUMENTS 3,237,865 A * 3/1966 Kovach
4,436,431 A * 3/1984 Strong et al.
4,534,654 A * 8/1985 Alt et al.
4,704,071 A * 11/1987 McCullough
4,850,701 A * 7/1989 Stegemoeller
4,854,714 A * 8/1989 Davis et al.
5,580,166 A * 12/1996 Schmittchen et al.
5,803,596 A * 9/1998 Stephens
5,908,240 A * 6/1999 Hood

FOREIGN PATENT DOCUMENTS

DE 42 10 430 10/1993
DE 42 11 139 10/1993

* cited by examiner

*Primary Examiner*—Tony G. Soohoo
(74) *Attorney, Agent, or Firm*—Collard & Roe, P.C.

(57) ABSTRACT

The invention relates to a mixing and conveying device for mixing and subsequently conveying semifluid materials, in particular mortar and concrete. The device comprises a compressor for generating compressed air, and a mixing vessel connected to a conveying conduit and an agitator gear. The mixing vessel is charged with the material to be mixed and conveyed, and compressed air is admitted into the mixing vessel for discharging the semifluid materials through the conveying conduit. The agitator gear is driven by at least one compressed air motor that is supplied with a proportion of the compressed air generated by the compressor.

30 Claims, 6 Drawing Sheets

METHOD AND DEVICE FOR MIXING AND CONVEYING CONCRETE

BACKGROUND OF THE INVENTION

1. Field of the Invention

The invention relates to a mixing and conveying device for discontinuous mixing interrupted by feeding processes, and subsequent conveying of semifluid materials.

2. The Prior Art

These devices are employed in the construction industry for mixing and conveying semifluid materials, in particular semifluid materials with low water content, for example mortar and flooring concrete. In this process, the components of the semifluid material are typically sand, a binding agent and water. These substances are first loaded into a mixing vessel through a filling opening and subsequently mixed by the agitator gear. The cover of the mixing vessel is closed and compressed air is admitted into the mixing vessel. The semifluid material contains lumps and bubbles of compressed air, and the material pressed through a conveying conduit that is connected to a short outlet pipe located in the lower zone of the mixing vessel. The air bubbles are formed because the blades of the agitator gear, which continue to run, periodically sweep the outlet opening leading into the conveying conduit. To convey the material, additional compressed air is blown in through another conduit feeding into a short outlet pipe. Such mixing and conveying devices are designed with an integrated or a separate compressor.

There are known devices that contain an integrated compressor. Oil-injected rotating compressors are used in such mixing and conveying equipment in most cases. An electric motor or an internal combustion engine drives the compressor element in the rotating compressors either directly or via a belt or toothed gear drive. No switching couplings are employed between the drive motor and the compressor element for cost reasons and because of other engineering drawbacks, i.e. the compressor element is always jointly driven when the drive motor is in operation.

The agitator gear is driven either via a switchable belt drive and a cardan shaft arranged between the drive motor and the agitator gear, or via a hydraulic motor mounted on the agitator gear, and a hydraulic pump attached to the drive motor.

It is cost effective to employ the power output of the drive motor as efficiently as possible, i.e. to achieve the shortest possible mixing and conveying time periods for a defined quantity of the viscous material.

Since the known devices do not contain a switching coupling device between the drive motor and the compressor element, the compressor is driven during the course of the mixing phase. At this stage, no compressed air is required for conveying any material. Therefore, the compressor is running idle, and consumes a notable proportion of the power output of the drive motor that is consequently not available for the mixing process.

The driving torque required for the agitator gear has the highest value at the start of the mixing phase and then drops quickly when the charged material is thoroughly mixed into a pasty compound. Furthermore, the driving torque required for the agitator gear is highly dependent upon the rotational speed of the agitator gear. Reducing the rotational speed of the agitator gear at the start of the mixing phase would reduce the required driving torque and the required driving power output. However, the known mixing and conveying devices do not provide for efficiently reducing the rotational speed of the agitator gear.

The reason for not offering such a reduction, is that transmissions with variable speed ratios between the drive motor and the agitator gear, or controllable hydraulic motors, are not used due to their high cost. A change in the rotational speed of the agitator gear is possible via a change in the rotational speed of the drive motor, in conjunction with hydraulic motors, by means of a bypass control capability with high power output losses. If an internal combustion engine is employed as the drive motor, narrow limits are set for any reduction in the number of revolutions. Moreover, a reduced rotational speed of the drive motor means a reduction in the power output of the motor. When an electric motor is employed as the drive motor, no drives with variable rotational speed are considered due to its high cost.

Therefore, in conjunction with a mixing and conveying device according to the state of the art, the driving power output required for the agitator gear has a maximum output at the start of the mixing phase. The drive motor and the agitator gear have to be coordinated with each other because the motor may otherwise be stalled by the agitator gear. The available power capacity of the drive motor cannot be completely utilized for the mixing process in the course of the mixing phase.

In the conveying phase, a rotational speed that is reduced from the mixing phase would be desirable, i.e. a rotational speed that would be sufficient for thorough mixing and for supporting the formation of lumps. However, in the known mixing and conveying equipment, the agitator gear operates during the conveying phase with an unnecessarily high rotational speed and with an unnecessarily high driving power output, especially if the rotational speed of the drive motor is increased in the course of the conveying phase to generate as much compressed air as possible for the conveying process. The unnecessarily high power requirement of the agitator gear is not available for the generation of compressed air, i.e. for conveying the viscous material.

A further disadvantage of the known mixing and conveying devices equipped with hydraulic pumps and hydraulic motors is the high costs incurred for the additional hydraulic circulation. German Patent DE 42 11 139 A1 discloses the combination of the oil circuit of the rotational compressor and the hydraulic circuit. This system has not been widely accepted until now, presumably because the high air component contained in the compressor oil causes substantial problems in the hydraulic system.

A further disadvantage associated with the known mixing and conveying devices having belt transmissions and cardan shafts are the harmful rotational oscillations of the power or drive train and vibrations resulting therefrom that lead to substantial noise development. Such mixing and conveying devices are described in German Patent DE 42 10 430 A1. This type of drive causes engineering restrictions that have higher manufacturing costs. Furthermore, the switchable belt drive contains a tensioning roller, actuation levers, a cardan shaft, reduction gear used for reducing the number of revolutions, a plurality of bearings, and systems for lubricating the bearings, these components substantially contribute to the high manufacturing costs. Moreover, the high maintenance requirements of the switchable belt drive gear represent another disadvantageous factor.

Known mixing and conveying devices with separate compressors are supplied with compressed air by mobile or transportable compressors set up at the construction site.

Typically, an electric motor is employed for driving the agitator gear. The drawback in this case is that these devices are dependent on an additional power connection that is not always available at construction sites.

SUMMARY OF THE INVENTION

Therefore, it is an object of the present invention to improve the known mixing and conveying devices by increasing the output capacity of the drive motor during both the mixing phase and the conveying phase. In addition, the engineering expenditures, the manufacturing costs, and the maintenance for the device of the present invention are reduced. Furthermore, the operating reliability of this a device is increased and its useful life is prolonged.

These and other objects are accomplished by providing the motor drive of the agitator gear with at least one compressed air motor. These motors are supplied with a proportion, preferably with 20% to 100%, of the compressed air generated by the compressor, and have a rotational speed that can be adapted to the various operating phases of the mixing and conveying process to influence the feed of compressed air to the compressed air motors and the discharge of exhaust air from the compressed air motors. A multi-component agitator gear is provided having individual components driven separately by a compressed air motor. Alternatively, several compressed air motors operating on a common shaft or coupled by a suitable transmission may drive a single-part agitator gear.

The compressed air motors contain several inlets for the compressed air and several outlets for the exhaust air. These compressed air motors are preferably connected with different, separate operating chambers or with different sections of the housing of the same operating chambers. The rotational speed can be changed by switching the feed of compressed air or the discharge of exhaust air in the inlets and outlets.

Compressed air motors are especially suited for this application purpose because of their rotational speed. Furthermore, these motors are also capable of delivering driving torques that are above their rated torque values, whereby the number of revolutions drops as the driving torque increases.

Therefore, the compressed air motors provide high driving torque to the agitator gear at the start of the mixing phase. Then, as the rate of revolutions decreases, the driving torque required for the agitator gear is lowered. The lower driving torque, combined with the lower rotational speed, leads to the maximum driving power delivered being reduced at the start of the mixing phase. Therefore, compressed air motors have lower power than the output for the drives comprising belt transmissions and cardan shafts, or hydraulic motors and hydraulic pumps.

The present invention provides mixing and conveying devices comprising an integrated compressor. The use of compressed air motors is advantageous because it leads to disengagement of the rotational speed of the drive motor and the agitator. The drive motor is capable of operating at full power capacity and with high rotational speed both during the mixing phase and the conveying phase to deliver as much compressed air as possible for driving the agitator gear and for conveying the viscous material.

The rotational compressors usually employed in mixing and conveying equipment have compression chambers which are formed between the rotors and the housing of the compressor element. Such compression chambers cyclically open in the course of rotation of the rotors. In the housing that defines the compression chambers, openings can be provided through which compressed air can be tapped from or fed into the compression chambers in the compressor element already sealed off from the intake zone at a pressure that is substantially constant in terms of time, and which is in the range between the intake pressure and the operating pressure. The selection of the position of these connections is determined by the amount of the intermediate pressure.

By connecting these connections in an alternating manner with the inlets and outlets of the compressed air motors, it is possible to change the pressure difference between the inlets and outlets of the compressed air motors in a controlled manner. In addition, the pressure difference between the inlet and the outlet of the compressed air motors can be influenced by a variable bypass. With these measures it is possible to adapt the rotational speed of the compressed air motors to the operating phases.

According to a preferred embodiment of the invention, the compressed air is fed to the compressed air motors at a pressure substantially corresponding with the operating pressure of the compressor.

Furthermore, it is preferred that the compressed air is supplied to the compressed air motors at a temperature substantially corresponding with the final compression temperature of the compressor. In oil-injected rotational compressors, the temperature is between 70° C. and 100° C. The compressed air is tapped for this purpose in a location where no notable cooling has taken place as yet. It is possible to reduce a relatively high inlet temperature, so that the outlet temperature of the compressed air exiting from the compressed air motors will be safely above the ambient temperature for thermodynamic reasons, and no damaging condensation can occur. Furthermore, a maximum operating volume is obtained.

It is advantageous if the compressed air is heated in a heat exchanger before it is fed to the compressed air motors, to a temperature value above the compression temperature of the compressor. This will further increase the effective capacity of the compressed air during the expansion occurring in the compressed air motors. In mixing and conveying devices operating with an internal combustion engine as the driving motor, the compressed air can be heated, for example by a heat exchanger with the cooling fluid or the stream of exhaust gases from the internal combustion engine.

Furthermore, the compressed air can be fed to the compressed air motors with an oil content of preferably 0.5 to 50 mg oil per kilogram of air. As opposed to a dry operation, such lubrication of the compressed air motors increases their degree of efficiency and their operating reliability.

If oil-injected compressors are employed, the preferred oil content in the compressed air for the compressed air motors is achieved by tapping the compressed air in a suitable location situated upstream of the separation of the oil in the compressor. For example upstream of the coalescence filter located in the oil separation container.

Compressed air can also be fed to the compressed air motors at a pressure in the range between the intake pressure and the operating pressure. Therefore, the compressed air can be withdrawn in a suitable site in the compressor element. Furthermore, the feed of compressed air to the compressed air motor can take place via valves being opened between various tapping points.

The air exiting from the compressed air motors is preferably recycled into the circuit of the compressor. This offers the advantage that the oil for lubricating the compressed air motors will not escape into the environment, but is rather recycled into the compressor circuit. One possibility for accomplishing such recycling, is to return the oil into the inlets of the rotational compressor.

The air can also be recycled into the compressor element, specifically in a location where a pressure prevails that is in the range between the intake pressure and the operating pressure. This intermediate pressure is superimposed by minor pressure variations whose amplitude approximately corresponds with the pressure difference between two neighboring compression chambers located within the zone of the recycling site. Under operating conditions in which no recycling takes place, varying flow processes may ensue between the compression chambers and the volume in the recycling conduit, and cause capacity losses. To avoid this, it is advantageous if the exhaust air is recycled into the compressor element via a check valve. A volume is enclosed in the compressor element between the check valve and the compression chambers that is smaller than the volume of the compression chamber at the connection of the recycling conduit, and preferably less than 2%.

The exhaust air can also be discharged from the compressed air motor by connecting the outlet of the compressed air motor during the conveying process to the compressed air feed of the mixing vessel. Recycling or discharging of the exhaust air can be carried out via valves opened between different recycling points. A great number of possibilities are available for influencing, in a controlled manner, the pressure difference in the compressed air motors between the inlets and the outlets.

In a preferred embodiment of the invention, the compressed air is fed to a compressed air motor at the operating pressure of the compressor. The exhaust air of the compressor is recycled within the intake zone, or alternatively, into the compressor element at a location where the pressure is in the range between the intake pressure and the operating pressure. Switching between the two alternative recycling possibilities takes place by use of a valve. During the mixing phase, the return line on the outlet of the compressed air motor is connected with the intake zone of the compressor, so that the maximal pressure difference is available to the compressed air motor between the inlet and the outlet. During the conveying phase, the return line on the outlet of the compressed air motor is connected with a connection located on the housing of the compressor element. At this point, an intermediate pressure is preferably a pressure of about 2% to 60% of the operating pressure. This recycling reduces the pressure difference between the inlet and the outlet of the compressed air motor and its rotational speed drops to the value desired during the conveying phase.

Returning the exhaust air into the compression chambers in the compression element that are already closed, is advantageous because the compressed air motor is supplied within an inner circuit, so that substantially the entire volume of the intake flow of the compressor element is available as compressed air for conveying the viscous material. The compressor element can be dimensioned in a substantially smaller way as opposed to the case in which the exhaust air of the compressed air motor is returned into the environment or into the intake zone of the compressor element.

In another preferred embodiment of the invention, the compressed air is supplied to a compressed air motor at the operating pressure of the compressor, whereas its exhaust air is passed into the intake zone of the compressor or discharged into the environment, or alternatively fed into the mixing vessel. Reversing between the two alternatives is accomplished by at least one valve. During the mixing phase, the exhaust air of the compressed air motor is passed into the intake zone of the compressor, or discharged into the environment, so that the maximal pressure difference is available to the compressed air motor between the inlet and the outlet. If the exhaust air of the compressed air motor is recycled into the intake zone of the compressor, an internal circulation is formed, so that the ambient air does not need to be purified through the inlet filter. This leads to a prolonged useful life of the filter. If the exhaust air is discharged into the environment, for example via a blow-off sound absorber, the return conduit can be dispensed with.

During the conveying phase, the exhaust air of the compressor is passed into the mixing vessel, where the prevailing pressure is in the range between the intake pressure and the operating pressure of the compressor.

Substantially the entire compressed air generated by the compressor is then first passed through the compressed air motor and then into the mixing vessel for conveying the mixed material.

The operating pressure of the compressor adjusts itself with respect to the overall compressed air consumption, and divides itself by self-adaptation to the given conveying process; a pressure difference between the inlet and the outlet of the compressed air motor, and a difference between the mixing vessel and the environment.

If the exhaust air of the compressed air motor contains oil, it is passed through a oil-separating element before it exits into the environment or enters the mixing vessel. The separated oil is recycled into the circuit of the compressor.

Foreign matter may cause blocking of the agitator gear. This blockage can be eliminated by briefly reversing the direction of rotation. Therefore, in another embodiment of the invention, provision is made for the use of a compressed air motor with a reversible direction of rotation.

Furthermore, a method for controlling and operating a mixing and conveying device is provided. In this case, the compressed air generated by the compressor is employed during the mixing phase only for supplying the compressed air motors and driving the agitator gear. The compressed air is used for both conveying the viscous material and for supplying the compressed air motors driving the agitator gear.

In a preferred method, compressed air motors are employed for driving the agitator gear, whereby all of these motors are supplied with compressed air during the conveying phase, but not during the mixing phase.

According to a preferred implementation of the method, the pressure difference between the inlet and the outlet is influenced by the compressed air motor in such a way that the rotational speed of the agitator gear is higher during the mixing than in the course of the conveying phase. For this purpose, the pressure difference existing between the inlet and the outlet of the compressed air motors is set higher during the mixing than in the course of the conveying phase.

The pressure difference between the inlet and the outlet of the compressed air motors is changed by throttling, in a controlled manner, by reversing the feed of the compressed air, or the discharge of the exhaust air between different recycling points in the compressor. At this point, the prevailing pressure is substantially the intake pressure, the operating pressure or an intermediate pressure.

According to yet another variation of the method, the pressure difference between the inlet and the outlet of the compressed air motors can be influenced by feeding the exhaust air of the compressed air motors into the mixing vessel in the course of the conveying phase. A pressure is built up in the mixing vessel whose amount influences the pressure difference and thus the rotational speed of the compressed air motors.

Furthermore, release of both the supply of conveying air the reduction of the rotational speed of the agitator can occur by use of a manually or automatically actuated switching device after the mixing vessel has been closed.

Moreover, it may be useful to design the control of the mixing and conveying device in such a way that any possible blockage of the agitator is detected automatically and a temporary automatic reversal of the direction of rotation is triggered in that way. This is accomplished, because the consumption of compressed air of the compressed air motor practically drops to zero during a shutdown.

In addition, it is possible through the use of a compressed air motor to reduce the cost of construction elements and the manufacturing costs of other known devices.

As opposed to a variable belt drive with a connected cardan shaft, the present invention allows greater engineering freedom because only one air feed and one exhaust conduit needs to be installed between the compressor and the mixing vessel. If the exhaust air of the compressed air motor is passed into the mixing vessel during the conveying phase, and discharged into the environment during the mixing phase, only one compressed air conduit is needed between the compressor and the mixing unit. This means that a conventional or an only slightly modified construction site-type compressor can be employed. This results in only minor restrictions to the arrangement of the compressor and the mixing vessel. Furthermore, the maintenance costs are reduced and the operational reliability is increased. Furthermore, vibrations and noise from a variable belt drive with a cardan shaft are avoided.

Most of these advantages apply to devices with a separate compressor as well. In addition, when compressed air motors are employed for driving the agitator gear, no additional electrical power connection is required as opposed to the usual drive with electric motors. A construction site compressor with an internal combustion engine is available for supplying the mixing and conveying device with compressed air, and such a compressor can supply the compressed air for the compressed air motor for driving the agitator as well. Drives for other devices installed on mixing and conveying equipment (such as devices for feeding the mixing materials, loading shovels etc.) can be driven by means of compressed air motors as well, so that no electric power supply is required at all.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
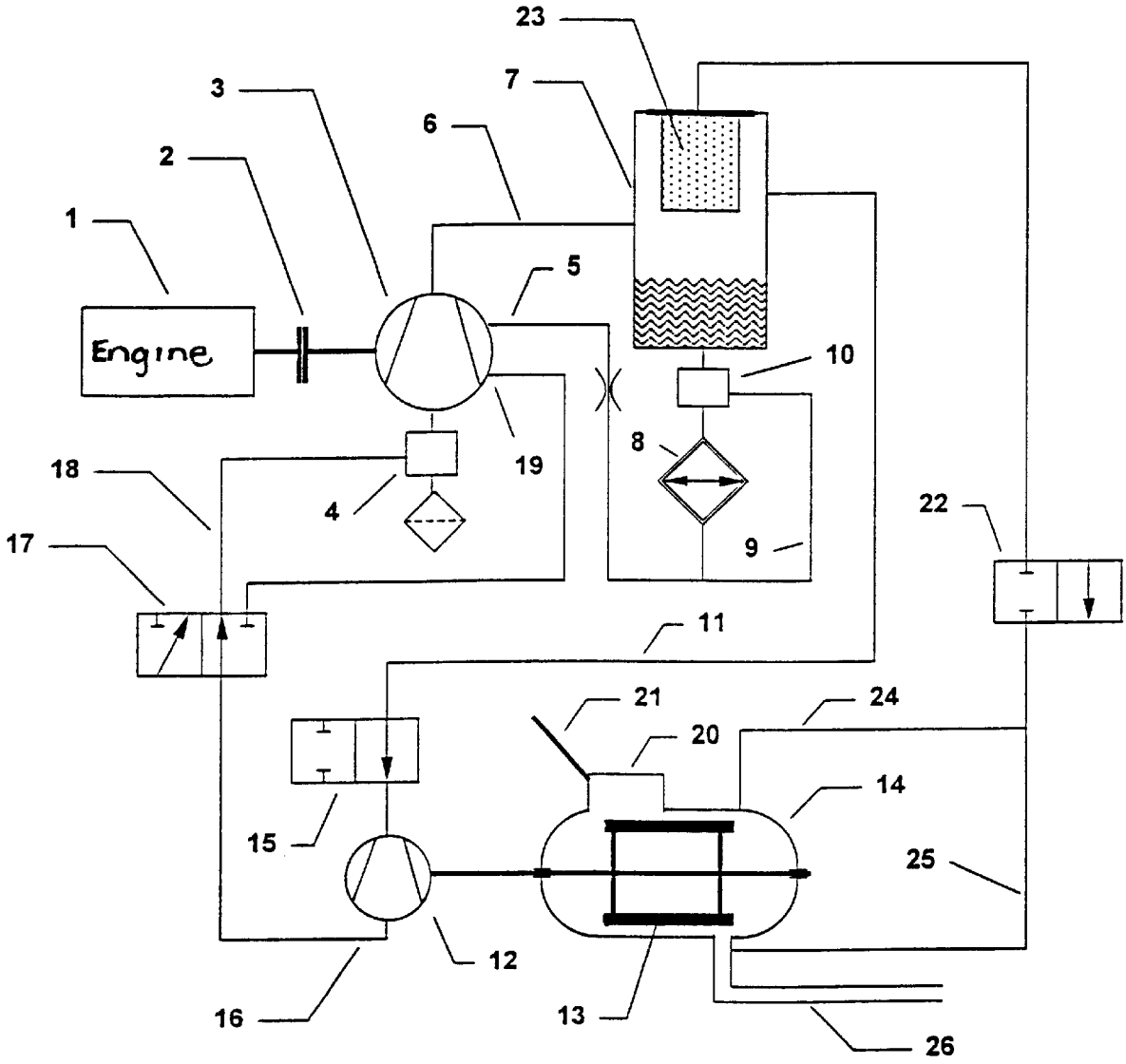
FIG. 1 shows a control diagram of the mixing and conveying device in the mixing phase, as defined by the present invention.

Referring now in detail to the drawings and, in particular, FIG. 1, an internal combustion engine 1 drives the compressor element 3 via a coupling 2. Compressor element 3 aspirates ambient air via the inlet valve 4 and compresses the air while oil is being injected, such oil being fed via the injection conduit 5, and conveys the compressed air/oil mixture via the pressurized conduit 6 into the oil separation container 7. The major part of the oil is separated from the stream of air in container 7 and collects in the lower zone of the oil separation container 7. From there, the oil is forced by the operating pressure through cooler 8, and back into injection conduit 5. The final temperature of the oil or the final compression temperature is controlled in this connection by a bypass 9 with a thermovalve 10.

Compressed air is passed via a pressurized conduit 11 at operating pressure to compressed air motor 12, which drives agitator gear 13 installed in mixing vessel 14. Provision is made in pressurized conduit 11 for a 2/2-way valve 15, by which the compressed air supply of compressed air motor 12 can be released and interrupted. The exhaust air of the compressed air motor is passed via an exhaust air conduit 16 to a 3/2-way valve 17.

When 3/2-way valve 17 is in one switching position, the exhaust air is passed via conduit 18 into the inlet valve 4; when it is in the other switching position, the exhaust air is passed into a recycling connection 19 on the housing of the compressor element 3. Recycling connection 19 is connected to an opening in the housing of compressor element 3. During operation, an intermediate pressure of about 50% of the operating pressure prevails in the compression chambers in the housing.

Mixing vessel 14 can be charged with the material to be mixed and conveyed via an opening 20, sealed by a cover 21, and pressurized when it has been sealed with cover 21.

Further details of the control system for the compressor and the mixing and conveying device are not shown here for the sake of simplification.

Cover 21 is opened in the mixing phase and 2/2-way valve 15 for the conveying air is closed. The compressor essentially generates compressed air for supplying compressed air motor 12. The 2/2-way valve 15 is opened and releases the compressed air to the compressed air motor 12. The 3/2-way valve 17 connects the outlet of the compressed air motor 12 with the inlet valve 4 of the compressor. The compressed air motor is supplied with the maximal pressure difference, so that it operates with a relatively high rotational speed and a relatively high driving power output. Cover 21 has to be closed before switching over to the conveying phase.

Figure 2:
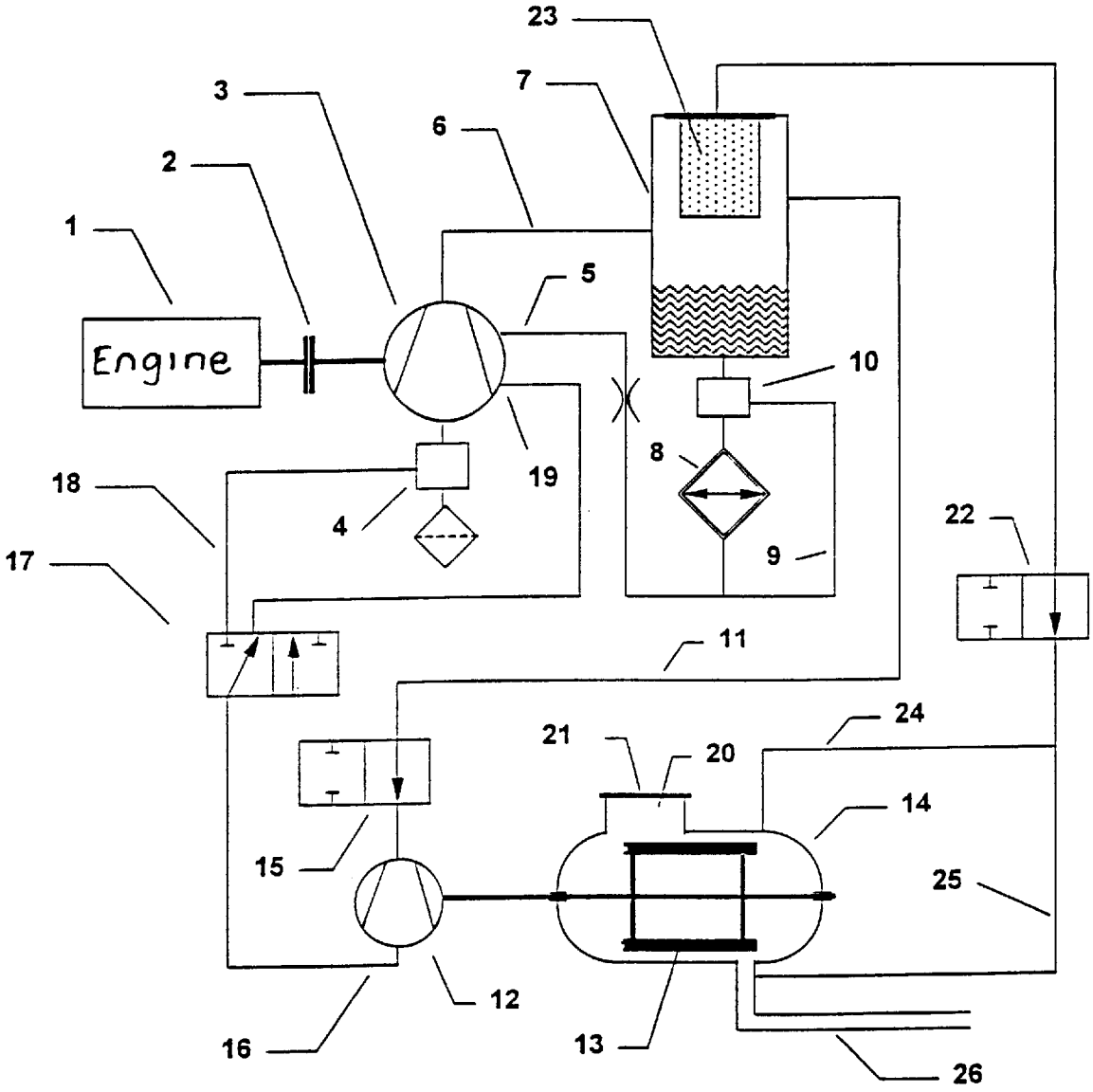
FIG. 2 shows a control diagram of the mixing and conveying device in the conveying phase.

As shown in FIG. 2, during the conveying phase, compressed air flows from the oil separation container 7 through a coalescence filter 23, an opened 2/2-way valve 22 and pressurized conduits 24 and 25, and into mixing vessel 14 and a conveying conduit 26. The 3/2-way valve is set in the other switching position and permits the exhaust air of the compressed air motor to now flow into the recycling connection 19 of the compressor element, where an intermediate pressure is prevailing, so that a lower pressure difference is applied to the compressed air motor than during the mixing phase. This causes the consumption of compressed air of the compressed air motor, as well as also its rotational speed and its torque and its driving power to decrease.

Since the compressed air for supplying the compressed air motor is circulated in the conveying phase in an internal circuit comprising compressor element 3, pressurized conduit 11, exhaust air conduit 16, 3/2-way valve 17 and return conduit connection 19 located on the compressor element 3, substantially the entire stream of the intake volume of the compressor element is available for conveying the semifluid material.

Figure 3:
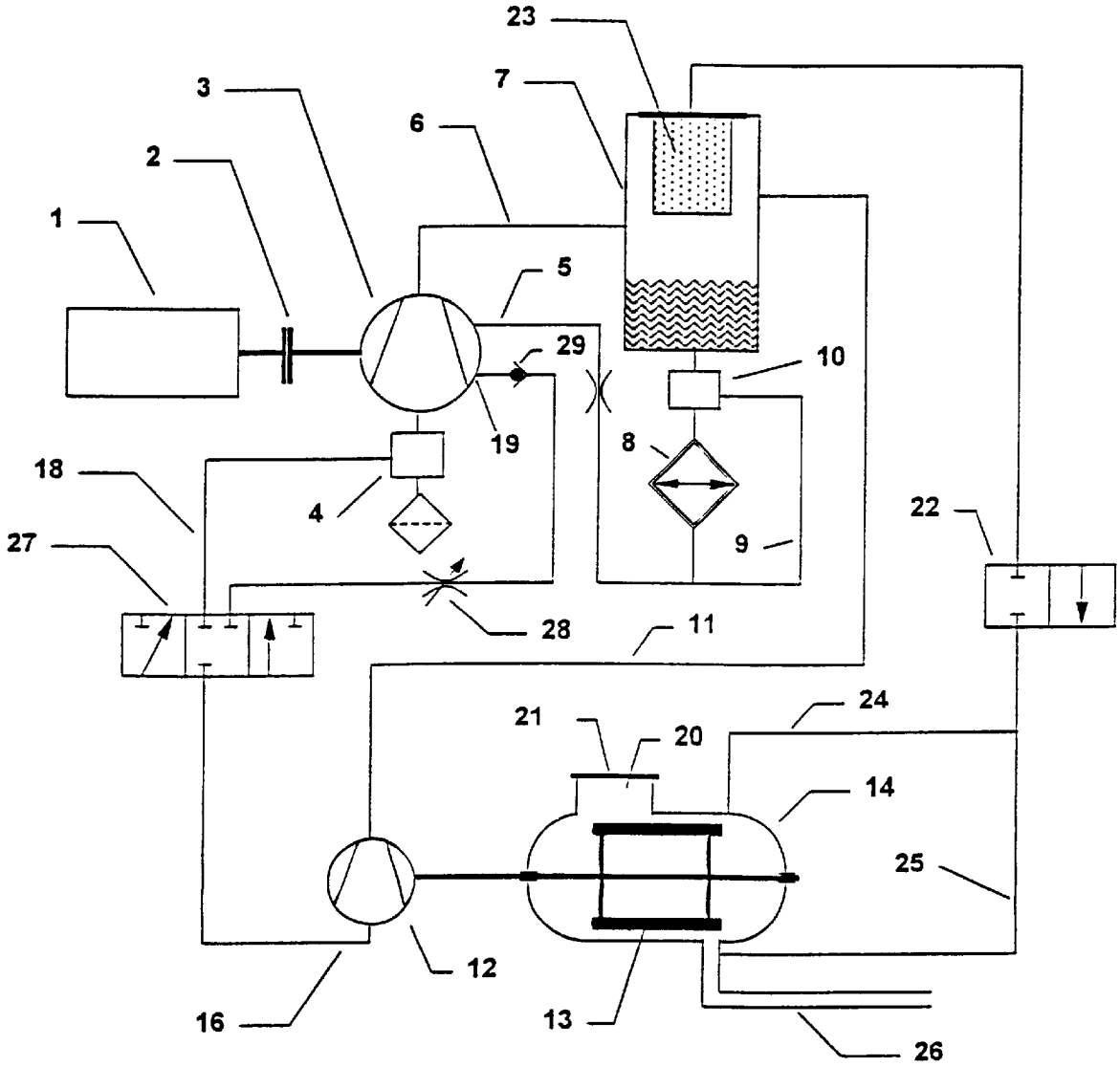
FIG. 3 shows a control diagram of a mixing and conveying device comprising an alternative valve arrangement in the idle run condition.

FIG. 3 shows an alternative control diagram, in which a 3/3-way valve 27 is employed for controlling compressed air motor 12 instead of using the 3/2-way valve 17. Furthermore, an additional adjustable throttling point 28 located in the conduit leading to the return conduit connection 19 is shown, by means of which further adaptation of the rotational speed, the torque, or of the driving power of the compressed air motor is possible in the course of the conveying phase. The valves 22 and 27 are shown in the switching positions for idle run and, respectively, shutdown of the mixing and conveying device.

A check valve 29 is arranged within return conduit connection 19. In the mixing phase, i.e. when the return conduit is closed by valve 27 and no exhaust air of compressed air motor 12 flows into the compressor element via the return conduit connection 19, check valve 29 prevents pulsating flows from occurring between the compression chambers and the return conduit.

Figure 4:
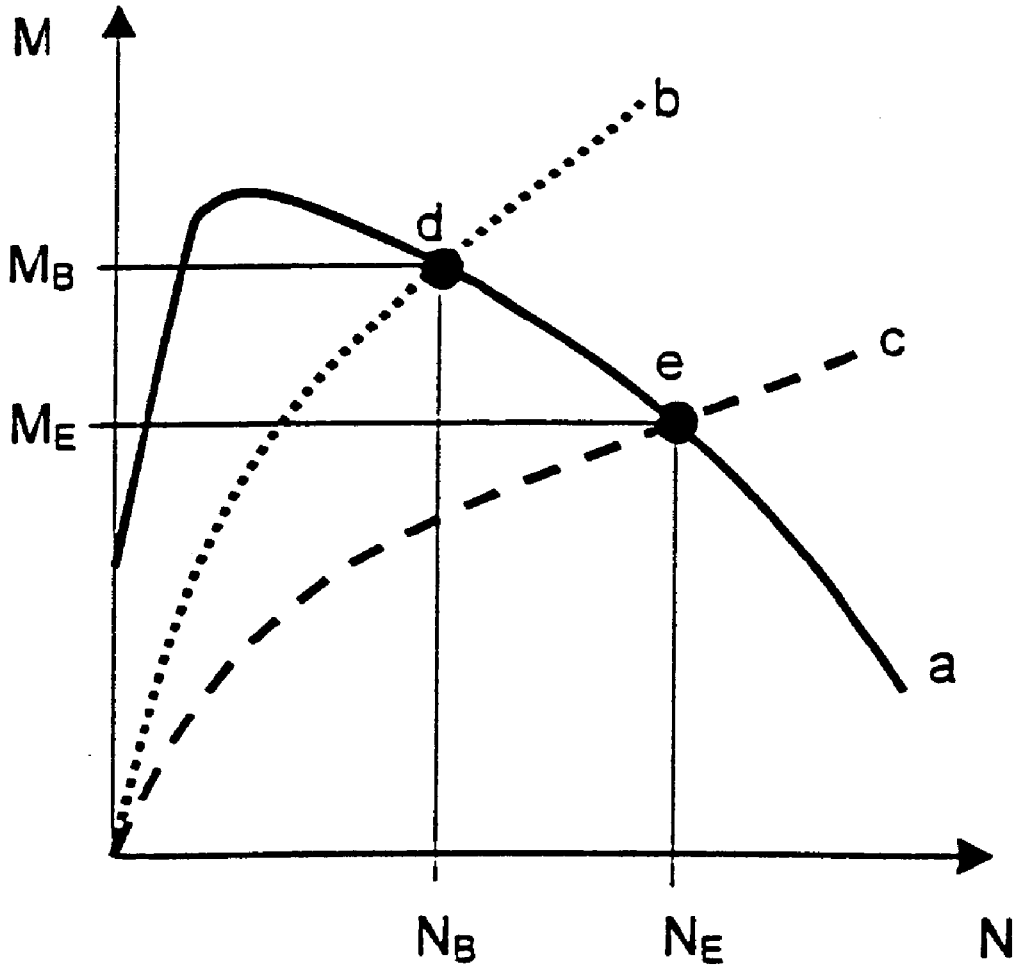
FIG. 4 shows the rotational speed characteristic of a typical compressed air motor and a typical agitator gear at the start and at the end of the mixing phase.

As shown in FIG. 4, at the start of the mixing phase, in which the mixed material still puts up relatively high resistance to the agitator gear, the compressed air motor operates at a lower rotational speed and a higher torque than at the end of the mixing phase. This adaptation automatically ensues from the curve of the rotational speed characteristic and was found to be advantageous versus known drives substantially operating during the mixing process with a constant number of revolutions.

The designations of the individual curves have the following meaning:

a: Rotational speed/torque characteristic of the compressed air motor;

b: Required torque of the agitator at the start of the mixing phase;

c: Required torque of the agitator at the end of the mixing phase;

d: Operating point of the agitator and the compressed air motor at the start of the mixing phase;

e: Operating point of the agitator and the compressed air motor at the end of the mixing phase.

Ne: Rotational speed of the agitator gear and the compressed air motor at the start of the mixing phase.

Ne: Rotational speed of the agitator and the compressed air motor at the end of the mixing phase.

Me: Rotational speed of the agitator and the compressed air motor at the start of the mixing phase.

Me: Rotational speed of the agitator and the compressed air motor at the end of the mixing phase.

Figure 5:
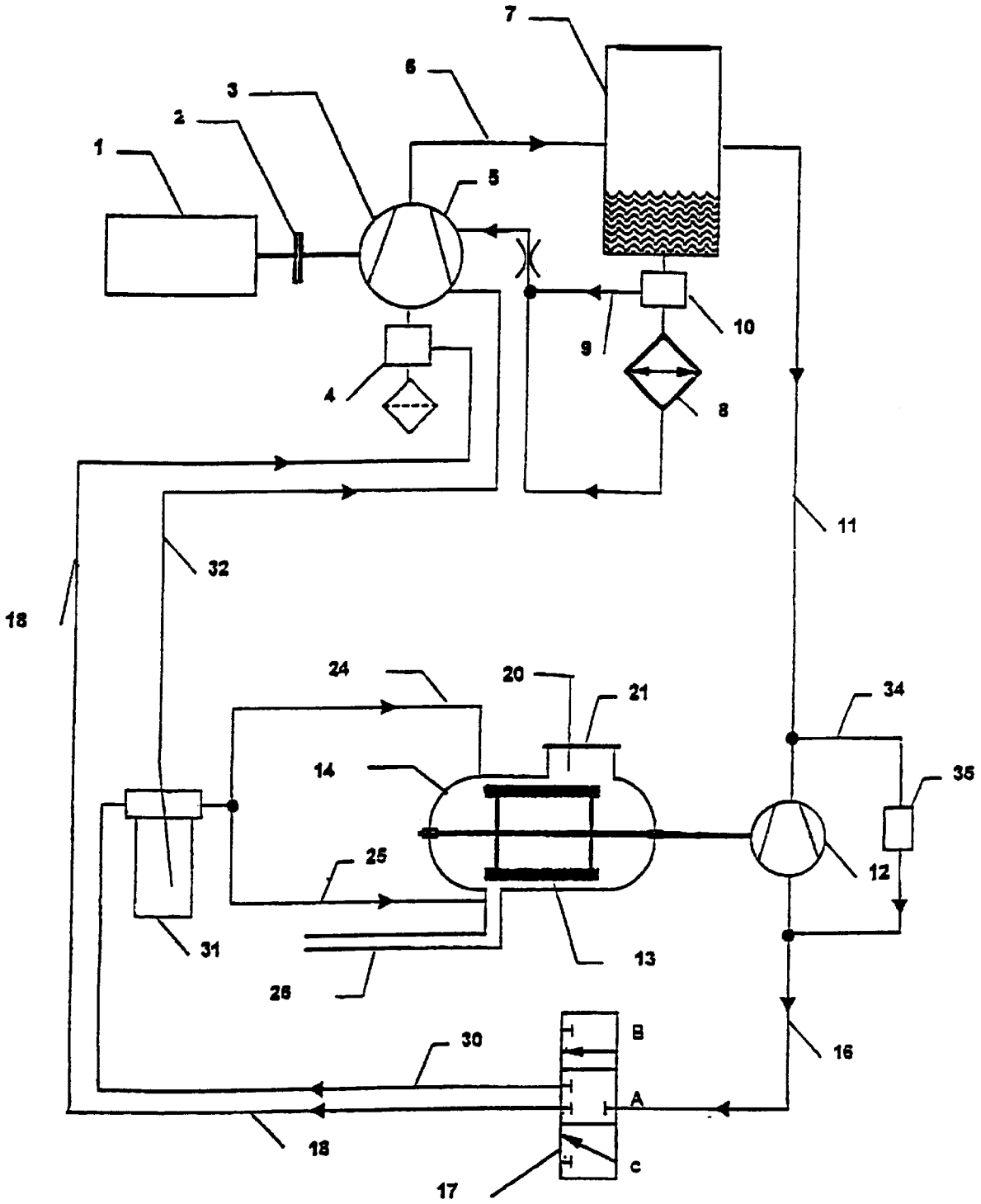
FIG. 5 shows a control diagram of the mixing and conveying comprising a connection variation of the components in the idle run.

FIG. 5 shows an alternative embodiment, in which the compressed air is directly passed from compressor element 3 to compressed air motor 12 both during the mixing and conveying phases. The outlet of compressed air motor 12 is connected to a 3/3-way valve. This valve permits the positions "standstill A", "mixing B" and "conveying C". In the position "A", exhaust air conduit 16 is blocked and compressed air motor 12 is shut down. In the mixing phase (position "B"), the exhaust air of compressed air motor 12 is passed through exhaust air conduit 16 and into inlet valve 4. This causes the maximally possible pressure difference to be adjusted via compressed air motor 12, so that it operates with a relatively high rotational speed, a relatively high torque and a relatively high driving power. Furthermore, a closed circulation ensues in this position for supplying compressed air motor 12 with compressed air. In the valve position "C", exhaust air conduit 16 is connected to the compressed air supply 30 of mixing vessel 14. An oil separation element 31 is located in compressed air feed line 30 to separate the oil from the compressed air and to recycle such oil into compressor element 3 by way of a recycling conduit 32.

Moreover, provision is made between the inlet and the outlet of compressed air motor 12 for a bypass conduit with a throttle valve 35. In the bypass conduit, the pressure difference can be limited via compressed air motor 12. Throttle valve 35 may be, for example a minimum-pressure valve that opens when a defined pressure difference is exceeded, and limits it to a defined value.

Figure 6:
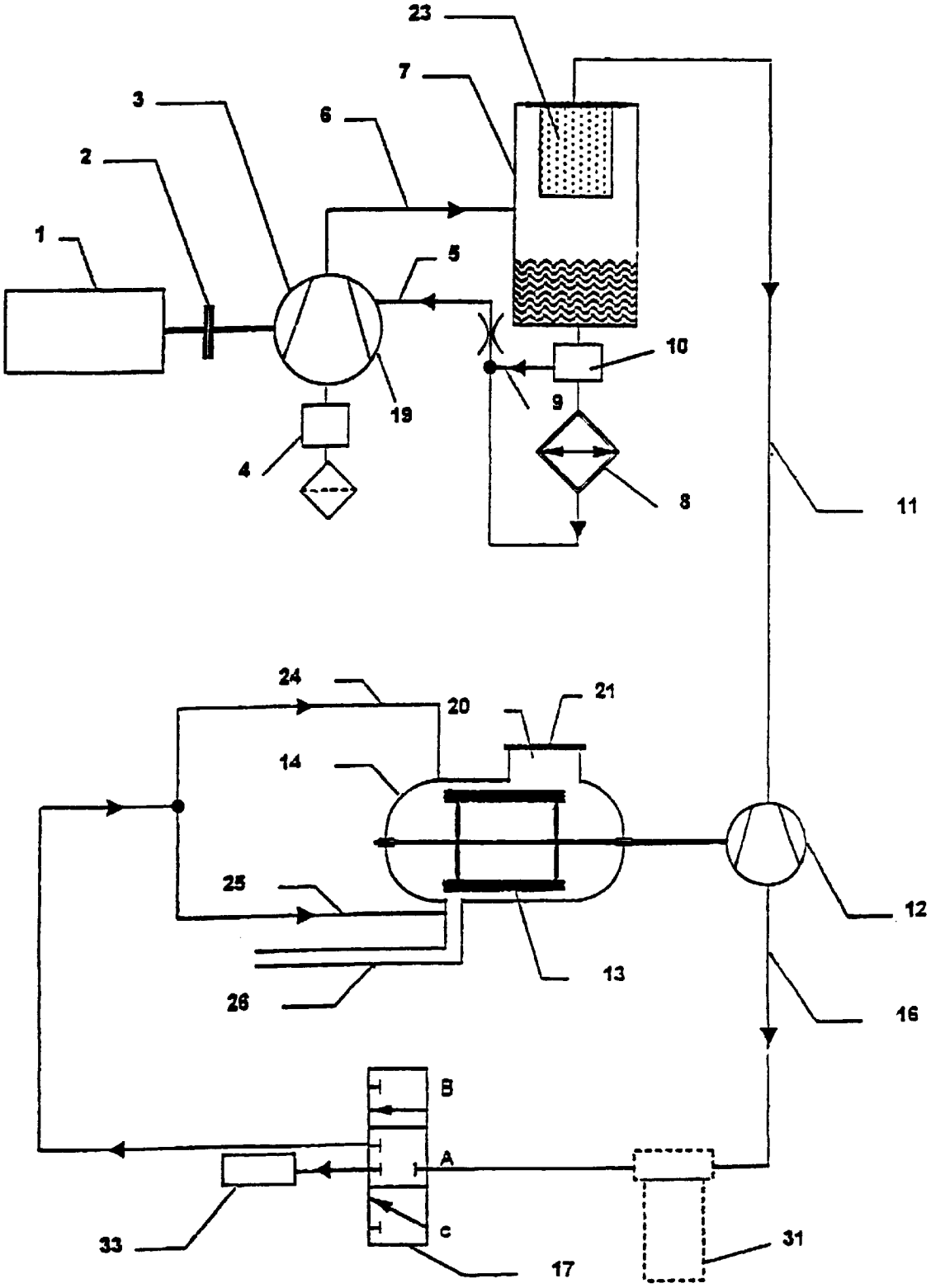
FIG. 6 shows a control diagram of another embodiment of the mixing and conveying device.

FIG. 6 shows another embodiment for interconnecting the components. In the present case, exhaust air conduit 16 of compressed air motor 12 is connected similarly to FIG. 5 with a 3/3-way valve 17 having the same switching capabilities. The difference is that in the course of the mixing process (valve position "B"), the compressed air is directly discharged into the environment via exhaust air conduit 16 and a blow-off sound absorber 33. If oil-containing compressed air is required for lubricating the compressed air motor, an oil-separating element 31 can be integrated in exhaust air conduit 16 instead of using coalescence filter element 23 in oil-separating container 7.

Accordingly, while only a few embodiments of the present invention have been shown and described, it is obvious that many changes and modifications may be made thereunto without departing from the spirit and scope of the invention.

What is claimed is:

1. A mixing and conveying device for discontinuous mixing being interrupted by feeding processes, and conveyance of semifluid materials, comprising:

a mixing vessel (14);

a conveying conduit (26) connected to the mixing vessel (14);

a motor-driven agitator gear (13) connected to the mixing vessel (14);

a compressor element (3) connected to a power source for generating compressed air; and at least one compressed air motor (12) connected to and driving the agitator gear (13), and being supplied with compressed air from the compressor element (13);

wherein the mixing vessel is filled with the material being mixed and conveyed, the material is discharged through the conveying conduit (26) by the compressed air generated in the compressor element (3).

2. The mixing and conveying device according to claim 1, further comprising a control device for controlling the compressed air and allowing for adaptation of the rotational speed of at least one compressed air motor (12) to different operating phases of the mixing and conveying process.

3. The mixing and conveying device according to claim 1, wherein at least one compressed air motor (12) drives the agitator gear (13) individually so that the rotational speed of the agitator gear is varied by switching said at least one motor (12) on or off.

4. The mixing and conveying device according to claim 1, wherein at least one compressed air motor (12) comprises a plurality of inlets for the compressed air and a plurality of outlets for the exhaust air, said inlets and outlets are connected by separate housing sections, wherein the rotational speed of the compressed air motors (12) is varied by switching the feed of compressed air and the discharge of exhaust air on or off.

5. The mixing and conveying device according to claim 4, further comprising a variable bypass (9) located between said inlets and said outlets for influencing a pressure difference between the inlet and the outlet of one of the compressed air motors (12).

6. The mixing and conveying device according to claim 4, wherein the exhaust air of the compressed air motor (12) is recycled into the inlet of the compressor element (3).

7. The mixing and conveying device according to claim 1, wherein the compressed air is fed to the compressed air motor (12) at a pressure corresponding to an operating pressure of the compressor element (3).

8. The mixing and conveying device according to claim 7 wherein the compressed air is tapped into a location of the compressor element (3) where the pressure is in the range between an intake pressure and said operating pressure.

9. The mixing and conveying device according to claim 8, further comprising a plurality of valves opened between different tapping points for reversing the compressed air into the compressed air motor (12).

10. The mixing and conveying device according to claim 9, further comprising at least one valve for reversing and recycling the exhaust air.

11. The mixing and conveying device according to claim 10, wherein the compressed air motor (12) drives the agitator gear (13), and compressed air is fed to said compressed air motor at said operating pressure, and the exhaust air is recycled into said inlet and said compressor element, where the pressure is in the range between said intake pressure and said operating pressure, wherein the reversal between the two alternative routes of recycling takes place by said valves.

12. The mixing and conveying device according to claim 8, wherein the exhaust air of the compressed air motor (12) is recycled into the compressor element (3) where the pressure is in the range between said intake pressure and said operating pressure.

13. The mixing and conveying device according to claim 12, further comprising a check valve (29) for recycling the exhaust air into the compressor element (3), wherein a volume is enclosed between said check valve (29) and compression chambers in the compressor element (3), said volume being smaller than the volume of said compression chamber located at the recycling conduit.

14. The mixing and conveying device according to claim 1, wherein the compressed air is fed into the compressed air motor (12) at a temperature substantially corresponding to a final compression temperature of the compressor element (3).

15. The mixing and conveying device according to claim 7, further comprising a heat exchanger for heating the compressed air prior to being fed into the compressed air motor to a temperature above said final compression temperature of the compressor element (3).

16. The mixing and conveying device according to claim 1, wherein the compressed air comprises an oil content for lubrication of 0.5 to 50 mg oil per kilogram of air.

17. The mixing and conveying device according to claim 16, wherein the compressor element (3) comprises oil-injected rotational compressors and oil content of the compressed air is achieved by tapping into a location situated upstream of separation in the compressor element (3).

18. The mixing and conveying device according to claim 16, further comprising an oil separator (7) for passing the oil-containing air of the compressed air motor (12) therethrough before it is admitted into the mixing vessel (14) or discharged into the environment, and the separated oil is recycled from said oil separator into the circulation of the compressor element (3).

19. The mixing and conveying device according to claim 1, wherein the exhaust air of the compressed air motor (12) is recycled into the circulation of the compressor element (3).

20. The mixing and conveying device according to claim 1, wherein the exhaust air is admitted into the air feed of the mixing vessel (14).

21. The mixing and conveying device according to claim 1, wherein the exhaust air is discharged into the environment.

22. The mixing and conveying device according to claim 1, wherein the compressed air motor has a reversible direction of rotation.

23. A method for operating a mixing and conveying device for discontinued mixing, interrupted by feeding processes and conveyance of semifluid materials, comprising:

charging a mixing vessel with the material to be mixed and conveyed, said mixing vessel being connected to a conveying conduit and a-motor-driven agitator gear (13);

generating compressed air in a compressor element, and supplying said compressed air to at least one compressed air motor; and discharging the semifluid material from said mixing vessel via said conveying conduit when said mixing vessel is acted upon by the compressed air;

wherein during a mixing phase the compressed air only supplies said compressed air motor (12) and wherein during a conveying phase the compressed air conveys the semifluid material and supplies said compressed air motor (12).

24. The method for controlling and operating a mixing and conveying device according to claim 23, wherein said compressed air motor (12) drives said agitator gear (13), wherein said at least one compressed air motor (12) comprises a plurality of compressed air motors and are supplied with compressed air during the conveying phase, and some of said compressed air motors (12) are supplied with compressed air during the mixing phase.

25. The method for controlling and operating a mixing and conveying device according to claim 23, wherein said compressed air motor (12) comprises a plurality of inlets for the compressed air and a plurality of outlets for the exhaust air for varying the rotational speed, said inlets and outlets are varied by switching on and off the feed of compressed air and the discharge of the compressed air.

26. The method for controlling and operating a mixing and conveying device according to claim 25, wherein a pressure difference between said inlets and the outlets causes the rotational speed of said agitator gear (13) to be higher during the mixing phase than in the conveying phase.

27. The method for controlling and operating a mixing and conveying device according to claim 25, wherein a pressure difference between the inlets and the outlets of said compressed air motor (12) is higher during the mixing phase than during the conveying phase.

28. The method for controlling and operating a mixing and conveying device according to claim 25, further comprising changing the pressure difference with a bypass conduit located between said inlets and said outlets for variable throttling and reversing the feed of the compressed air and the discharge of the exhaust air between different tapping and recycling locations in said compressor element (3), wherein the pressure is the intake pressure, the operating pressure or an intermediate pressure.

29. The method for controlling and operating a mixing and conveying device according to claim 23, further comprising releasing and triggering the supply with compressed air and reducing the rotational speed of said agitator gear (13) by use of an actuated switching device for when said mixing vessel is closed.

30. The method for controlling and operating a mixing and conveying device according to claim 23, further comprising the step of automatically detecting any blockage in said agitator gear (13) and triggering a temporary, automatic reversal of the direction of rotation of said agitator gear (13).

* * * * *